US006291015B1

(12) United States Patent
Ferguson

(10) Patent No.: US 6,291,015 B1
(45) Date of Patent: Sep. 18, 2001

(54) PROCESS FOR CUTTING A FIBERGLASS PANEL AND SIMULTANEOUSLY SEALING THE EDGES THEREOF

(75) Inventor: John W. Ferguson, Perrysburg, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 471 days.

(21) Appl. No.: 08/684,204

(22) Filed: Jul. 19, 1996

(51) Int. Cl.[7] ..... B05D 3/12; B26D 3/00

(52) U.S. Cl. ..... 427/292; 427/289; 427/386; 427/387; 427/284; 83/53; 83/177

(58) Field of Search ..... 427/289–292, 427/374.2, 386, 387, 284; 83/53, 177

(56) References Cited

U.S. PATENT DOCUMENTS 4,226,662 * 10/1980 McCort ..... 427/284
4,244,989 * 1/1981 Noomen ..... 427/292
4,517,248 * 5/1985 Kik et al. ..... 428/457
4,735,566 * 4/1988 Squicciarini ..... 83/177
5,069,940 * 12/1991 Wenrick ..... 427/284
5,339,715 * 8/1994 Coleman ..... 83/53
5,516,551 * 5/1996 Anderson et al. ..... 427/284

* cited by examiner

*Primary Examiner*—Brian K. Talbot
(74) *Attorney, Agent, or Firm*—Inger H. Eckert; Stephen W. Barns

(57) ABSTRACT

A process for cutting a fiberglass panel comprises cutting the fiberglass panel with a liquid jet containing a sealant which coats and adheres to the cut edge of the panel, and thereafter curing the sealant to harden and encapsulate the edge of the panel to reduce the emanation of fiberglass dust particles therefrom.

10 Claims, No Drawings

PROCESS FOR CUTTING A FIBERGLASS PANEL AND SIMULTANEOUSLY SEALING THE EDGES THEREOF

FIELD OF THE INVENTION

The present invention relates generally to a process for cutting a fiberglass panel and simultaneously sealing the edges thereof. More particularly, the invention is directed to a process for cutting a fiberglass panel utilizing a liquid jet cutting device and simultaneously applying a sealant to the cut edges of the fiberglass panel, which sealant hardens the edges of the panel and reduces the emanation of small fiberglass particles therefrom.

BACKGROUND OF THE INVENTION

Fiberglass panels are widely used in the automotive and architectural fields as thermal and sound insulating media. Such panels may be formed into wall or ceiling boards, sound insulating decorative roof liners for motor vehicles, etc. Thus, it is often necessary to cut and shape large fiberglass panels to form smaller panels for particular commercial purposes. Prior art methods for cutting fiberglass panels, e.g., raw cutting, steel rule die cutting, water jet cutting, etc., generally result in non-rigid panel edges from which fiberglass dust particles emanate as the cut panels are handled and/or compressed in subsequent forming operations.

It would be desirable to develop a process for cutting a fiberglass panel, which process would simultaneously apply a sealant to the cut edge of the fiberglass panel to strengthen the edge and reduce the emanation of small fiberglass particles therefrom.

SUMMARY OF THE INVENTION

Accordant with the present invention, an improved process for cutting a fiberglass panel surprisingly has been discovered. The process comprises:

providing a fiberglass panel; cutting the fiberglass panel with a liquid jet to form a panel edge, said liquid jet containing a sealant, said sealant coating and adhering to the panel edge; and curing the sealant to harden and encapsulate the edge of the fiberglass panel.

The process for cutting a fiberglass panel according to the present invention is particularly useful for preparing automotive and architectural thermal and acoustical fiberglass panels.

BRIEF DESCRIPTION OF THE PREFERRED EMBODIMENTS

The present invention contemplates an improved process for cutting a fiberglass panel. The fiberglass panel is cut utilizing a liquid jet to form a cut edge on the panel. A sealant contained in the liquid jet coats and adheres to the edge of the panel, and is thereafter cured in order to harden and encapsulate the cut edge of the panel.

Fiberglass panels according to the present invention are well-known in the art and are prepared by conventional processes such as, for example, by drawing molten streams of glass into fibers and depositing the fibers in a collecting chamber where they settle, together with an applied binder, onto a traveling conveyor. The fibers form a substantially heterogeneously oriented mass of glass fibers laid in a substantially stratified relationship, in planes generally parallel to the surface of the conveyor. The continuously produced fibrous mass is thereafter conveyed through compression, resin curing, and cutting stations to form moderately rigid panels having overall densities from about 3 to about 12 pounds per cubic foot. Methods for preparing fiberglass panels according to the present invention are more fully set forth in U.S. Pat. No. 5,149,920 to Meeker et al. which is incorporated herein in its entirety by reference thereto.

The fiberglass panel is cut utilizing a liquid jet. The liquid jet comprises a high velocity stream of liquid directed through a nozzle onto the fiberglass panel to be cut. The force of the liquid stream effectively cuts through the fiberglass panel thereby forming a cut panel edge.

Suitable liquids for use in the liquid jet include, but are not necessarily limited to, water and organic liquids such as hydrocarbon oils. A preferred liquid is water. The liquid typically is ejected from the nozzle at a pressure up to about 60,000 psi. Nozzle orifice sizes may range from about 0.003 inches to about 0.065 inches in diameter. Devices for producing the liquid jet according to the present invention are well-known in the art. A preferred device is the "PERMALIGN OMNIJET II" cutting head available from Jet Edge, Inc., Minneapolis, Minn.

A sealant is contained in the liquid of the liquid jet. The sealant may be introduced into the liquid jet by reduction of the sealant into the moving liquid jet stream. Alternatively, the sealant may be mixed with the liquid prior to forming the liquid jet. The sealant may be contained in the liquid at a concentration up to about 5% by weight. During the cutting operation, the sealant coats and adheres to the cut edge of the fiberglass panel, and wicks a short distance into the interior of the cut panel.

The sealant may be any material which, when cured, will increase the rigidity of the cut edge of the panel and encapsulate it to reduce the emanation of small particles of fiberglass from the cut edge when the panel is subsequently handled or formed. Suitable sealants include, but are not necessarily limited to, polysulfides, silicones, polyurethanes, acrylics, neoprene, polyvinyl chloride plastisols, polyesters, epoxies, phenolics, urea resins, furan resins, and the like, as well as blends and copolymers thereof. A preferred sealant is available from H. B. Fuller Company under the product designation WB6915RE.

The sealant adhered to the cut edge of the fiberglass panel is then cured, to harden and encapsulate the edge. By the term "cure" as it is used herein is meant that the sealant is hardened. Many disclosed sealants, for example, may be cured merely by allowing the sealant to air-dry. Other sealants may actually cross-link during the curing process. Some of the disclosed sealants conveniently may be cured by heating the cut edge of the fiberglass panel up to a temperature of about 750° F. The particular parameters for effecting the curing of the sealant will be readily apparent to one ordinarily skilled in the art, depending upon the sealant used.

EXAMPLE

A 0.36 inch thick fiberglass panel is cut completely through utilizing a water jet at a pressure of about 40,000 psi, to form a cut edge on the panel. A sealant, WB6915RE by H. B. Fuller Company, is educted into the water jet during the cutting operation at a concentration of about 0.07 gal./minute. At a panel cutting rate of about 100 linear inches per minute, the cut edge of the panel is coated with the sealant to a depth of about 0.4 inch. The edge of the panel is then heated to a temperature of about 550° F. for about 1 minute to harden and encapsulate the panel edge.

This Example may be repeated with similar success by substituting the generically or specifically described ingredients and/or parameters recited herein for those used in the preceding Example.

From the foregoing description, one ordinarily skilled in the art can easily ascertain the essential characteristics of this invention and, without departing from its spirit or scope, can make various changes and modifications in the invention to adapt it to various usages and conditions.

What is claimed is:

1. A process for cutting a fiberglass panel, comprising:

providing a fiberglass panel;

cutting the fiberglass panel with a liquid jet to form a panel edge, said liquid jet containing a sealant, said sealant coating and adhering to the panel edge; and curing the sealant to harden and encapsulate the edge of the fiberglass panel.

2. The process for cutting a fiberglass panel according to claim 1, wherein the liquid jet comprises water.

3. The process for cutting a fiberglass panel according to claim 1, wherein the liquid jet is ejected at a pressure up to about 60,000 psi.

4. The process for cutting a fiberglass panel according to claim 1, wherein the sealant is contained in the liquid jet at a concentration up to about 5% by weight.

5. The process for cutting a fiberglass panel according to claim 1, wherein the sealant is educted into the liquid jet.

6. The process for cutting a fiberglass panel according to claim 1, wherein the sealant is mixed with the liquid of the liquid jet.

7. The process for cutting a fiberglass panel according to claim 1, wherein the sealant is selected from the group consisting of polysulfides, silicones, polyurethanes, acrylics, neoprene, polyvinyl chloride plastisols, polyesters, epoxies, phenolics, urea resins, furan resins, and blends and copolymers thereof.

8. The process for cutting a fiberglass panel according to claim 1, wherein the curing is effected by air-drying the edge of the panel.

9. The process for cutting a fiberglass panel according to claim 1, wherein the curing is effected by heating the edge of the panel to a temperature up to about 750° F.

10. A process for cutting a fiberglass panel, comprising:

providing a fiberglass panel;

cutting the fiberglass panel with a water jet ejected at a pressure up to about 60,000 psi, to form a panel edge, said water jet containing up to about 5% by weight of a sealant educted thereinto, said sealant selected from the group consisting of polysulfides, silicones, polyurethanes, acrylics, neoprene, polyvinyl chloride plastisols, polyesters, epoxies, phenolics, urea resins, furan resins, and blends and copolymers thereof, said sealant coating and adhering to the panel edge; and curing the sealant by heating the edge of the panel to a temperature up to about 750° F., to harden and encapsulate the edge of the fiberglass panel.

* * * * *